United States Patent [19]

Schockmel

[11] 4,171,965

[45] Oct. 23, 1979

[54] METHOD OF MAKING GRANULATED SLAG

[75] Inventor: Robert Schockmel, Esch, Luxembourg

[73] Assignee: ARBED - Aciéries Réunies de Burbach-Eich-Dudelange S.A., Luxembourg, Luxembourg

[21] Appl. No.: 897,424

[22] Filed: Apr. 18, 1978

[30] Foreign Application Priority Data

Apr. 19, 1977 [LU] Luxembourg ..... 77160

[51] Int. Cl.[2] ..... C03D 19/08

[52] U.S. Cl. ..... 65/19; 65/20; 65/141

[58] Field of Search ..... 65/19, 20, 141

[56] References Cited

U.S. PATENT DOCUMENTS

| | | | |
|---|---|---|---|
| 2,210,999 | 8/1940 | Bartholomew | 65/141 X |
| 3,104,164 | 9/1963 | Osborne | 65/20 |
| 3,594,142 | 7/1971 | Margesson et al. | 65/20 |

FOREIGN PATENT DOCUMENTS

| | | | |
|---|---|---|---|
| 251437 | 4/1966 | U.S.S.R. | 65/20 |

*Primary Examiner*—Robert L. Lindsay, Jr.
*Attorney, Agent, or Firm*—Karl F. Ross

[57] ABSTRACT

Slag sand is produced by first mixing a stream of molten slag with a quantity of between 0.5 $m^3$ and 0.7 $m^3$ of water per ton of slag to chill the slag while leaving it above the pyroplasticity threshold. Thereafter water at a rate of between 0.3 $m^3$ and 0.4 $m^3$ is added to the slag to stiffen the stream and this stiffened stream is fed to a drum rotating at a rate between 600 rpm and 1000 rpm to break it up into fine granules which are collected on a foraminous belt.

5 Claims, 2 Drawing Figures

METHOD OF MAKING GRANULATED SLAG

FIELD OF THE INVENTION

The present invention relates to a slag sand and a method of granulating blast-furnace slag.

BACKGROUND OF THE INVENTION

The molten slag produced in the smelting of iron ore can be transformed into a solid granulate in the so-called jet process by directing a plurality of fine water sprays at a stream of the molten slag to break it up into slag particles. These quenched particles are caught in a basin or pit filled with water where they are completely quenched. Thereafter the water is drained away from the slag and the finished product is used as is.

Such slag has several serious disadvantages. First of all the particles pick up a considerable percentage, often between 10% and 20% by weight, of water. This extra water increases the transport costs for the slag or necessitates a later drying operation. Furthermore the particles thus produced are extremely compact and glass-like so that milling them or grinding them to a smaller size is a burdensome process, indeed in the cement industry up to 20% of the energy costs are often expended for such grinding. Obviously when between 70% and 75% of the slag cements are made from blast-furnace slag a considerable saving would result from any reduction in the moisture content of the granules.

Slag sand is also produced as an undesired secondary product in the production of expanded or lightweight blast-furnace slag. Such expanded slag is normally produced by flowing and mixing the stream of slag directly with water so as to expand it. The still pyroplastic mass is then poured over a rotating drum that subdivides the stream into tiny particles which are thrown through the air or through a water-mist cloud for sufficient cooling that the particles, when they eventually come to rest, are no longer plastic. A very small quantity of water, in the neightborhood of 0.7 $m^3$-1.0 $m^3$ per ton of slag, is normally used to produce the desired relatively large clinker.

During the production of expanded slag as described above the fines under a mesh size of 3 mm are then screened out. These fines constitute slag sand, and rarely constitute more than 25% by weight of the expanded slag. For this reason the slag-expanding processes are normally set up to minimize the production of such slag sand whose separation is more trouble than it is generally considered to be worth.

OBJECTS OF THE INVENTION

It is therefore an object of the present invention to provide an improved slag sand.

Another object is to provide an improved method of granulating slag.

Yet another object is to provide an improved apparatus or system for producing granulated slag.

A further object is the provision of such a method and apparatus which produces granulated slag having an extremely low moisture content so that it is ideally suited for use in slag cements.

SUMMARY OF THE INVENTION

These objects are attained according to the instant invention by passing a stream of the freely flowing slag of comparatively low viscosity downwardly through a trough and mixing it with a limited quantity of water so that the viscosity is only slightly increased, with the slag remaining plastic and below the threshold of pyroplasticity. The thus-cooled slag is then mixed with additional water to stiffen it somewhat further, while still leaving it plastic, and is then poured on a rapidly rotating drum that reduces it to fine particles that are projected through the air to a collection location.

The cooling of the slag stream which effectively freezes it into a glassy condition takes place in a trough as described above which is between 2 m and 6 m long, and is formed of a succession of overlapping but spaced plates such as described in commonly owned and copending patent application Ser. No. 734,553 filed Oct. 21, 1976, whose entire disclosure is herewith incorporated by reference. The residence time of the slag in this trough is between 5 sec. and 8 sec., and can be controlled by an arrangement such as described in commonly owned and copending application Ser. No. 851,636 filed Nov. 15, 1977, whose entire disclosure is also herewith incorporated by reference. In accordance with the invention, and differing from the systems described in the above-mentioned applications, the water is added only in a quantity of between 0.5 $m^3$ and 0.7 $m^3$ of water per ton of slag, and only in the upstream third of the trough.

Thereafter the slag, which is still above the pyroplastic threshold, is further mixed with water so that a portion of it is cooled to below that threshold. To this end the slag is poured between a pair of upright horizontally spaced and inclined slot-forming plates while being mixed with water that is fed in at a rate of between 0.3 $m^3$ and 0.4 $m^3$ of water per ton of slag. The water used in accordance with this invention is the process water used to cool the blast furnace and has a temperature well above 40° C.

Thus in accordance with the instant invention it is possible to use an installation such as described in above-mentioned application Ser. No. 734,553, but in an altogether different manner so as not to expand but merely to granulate the slag. The conversion of this system for granulation lies mainly in the manner in which the water is fed in, the amount of water fed in, and the speed at which the drum is rotating. Such conversion can be effected relatively easily in the known equipment.

Thus the instant invention, although parallel in certain manners to the above-described systems, can be used to produce slag granules which differ totally from the expanded slag produced by these other systems. The progressive addition of small quantities of water does not produce expanded slag so that the resultant product has excellent hydraulic properties and does not have the crystalline structure that is so disadvantageous when using slag sand as, for example, in cement. This crystallization is normally caused by cooling the slag below a critical temperature with a large quantity of water relatively suddenly, that is by quenching. Such crystallization is a considerable problem in the production of slag sand. Indeed the use of small quantities of water to produce slag sand with minimum crystallization as in accordance with the instant invention would normally seem to be impossible.

An important element of the invention lies in the relatively rapid rotation speed for the drum. In accordance with this invention the drum is rotated at at least 600 rpm and normally at approximately 1000 rpm. In the expanding operations described in the above-mentioned copending applications the drums normally rotate at a speed of between 250 rpm and 500 rpm. It lies within the scope of this invention to increase the cooling between the drum and the collection location by generating a water mist in this region.

In the normal slag granulation the slag sand usually is collected in a water-filled basin having at one end a drain. According to this invention the slag sand is collected in a foraminous substrate, here on a conveyor belt formed as a screen such as described in Luxembourg patent applications 75.978 of Oct. 12, 1976 and 78.184 of Sept. 26, 1977.

SPECIFIC DESCRIPTION

Figure 1:
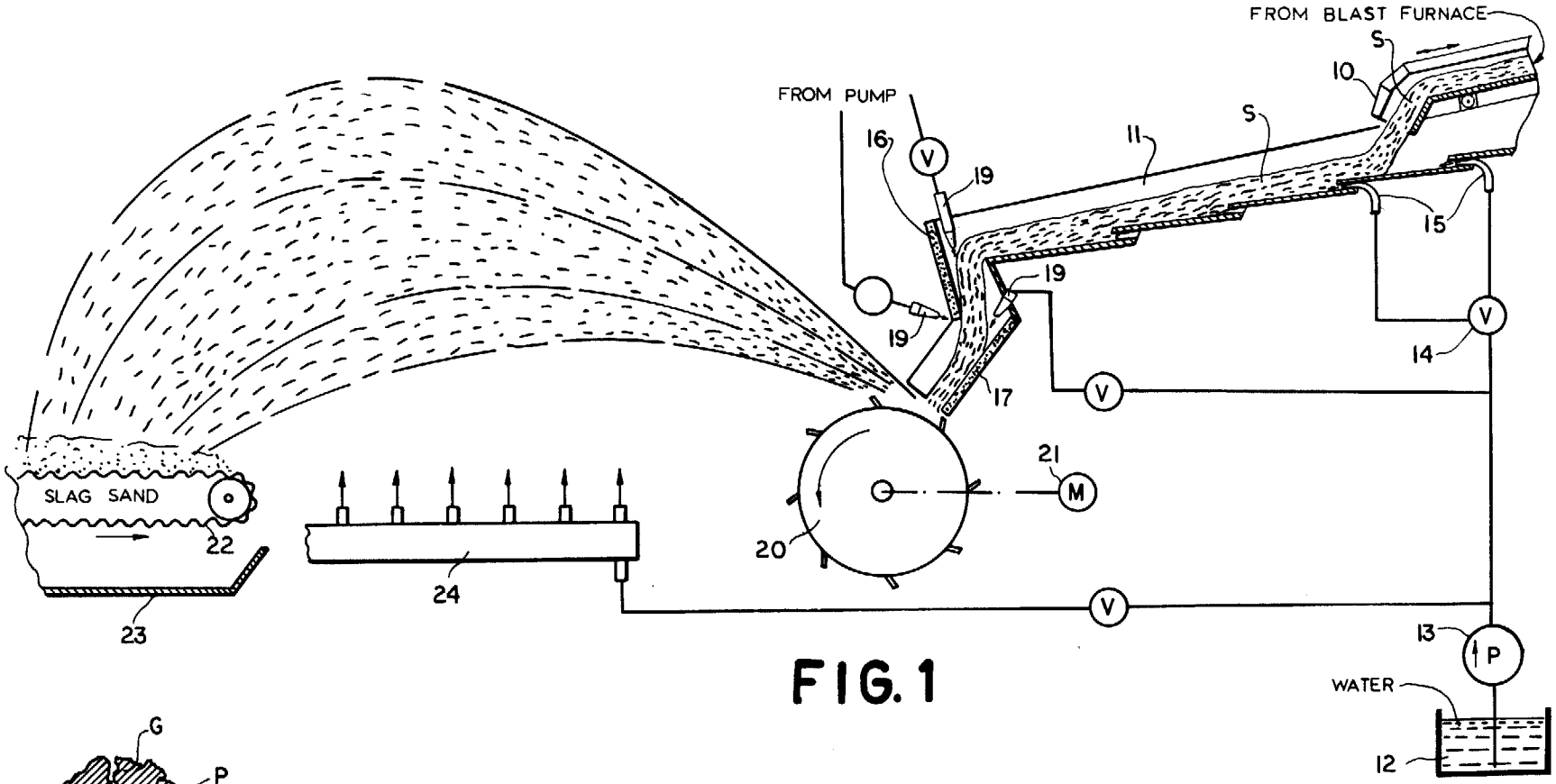
FIG. 1 is a partly diagrammatic side view of an apparatus for carrying out the method according to this invention.

As shown in FIG. 1 a stream S of slag is poured from the downstream spout end of an upstream trough 10 such as shown in the commonly owned application Ser. No. 734,553 and is poured into the upstream end of a trough 11 such as shown in commonly owned application Ser. No. 851,636 to flow downstream therein. Water from a supply 12 is forced via a pump 13 through a valve 14 to be introduced into the trough at nozzles 15 at the upstream third thereof. The water mixes with the slag in the stream S and cools it somewhat. Thereafter the slag flows at the downstream end of the trough 11 between a pair of plates 16 and 17 against which water from the pump 13 is projected via nozzles 18 and 19. Thereafter the stream S is poured onto a drum 20 which is rotated at high speed by a motor 21 to pass through the air above an array 24 of nozzles connected to the pump 13 which generates a water mist. The particles thus formed land on a foraminous belt 22 which is continuously rotated above a catch basin 23 so that water can drip out of the slag sand into this basin 23.

Figure 2:
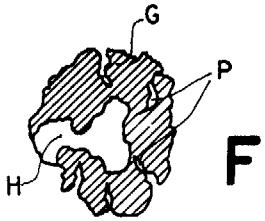
FIG. 2 is a large-scale sectional view through a granule of slag sand according to this invention.

FIG. 2 shows a granule G of the slag having a central hollow H and pores P.

SPECIFIC EXAMPLE

In an arrangement as described above the slag has a starting temperature between 1350° C. and 1550° C. and a degree of basicity between 1.2 and 1.5. At the nozzle 15 water is introduced at a rate of between 0.5 $m^3$ and 0.7 $m^3$ of water per ton of slag and at the nozzles 19 at a rate of between 0.3 $m^3$ and 0.4 $m^3$ per ton of slag. The trough 11 has an overall length between 2 m and 6 m and the nozzles 15 are in the upper third of this length.

The drum 20 is here rotated at a speed of 1000 rpm.

The product is granules such as shown in FIG. 2 having rounded points, pores P, and in many instances also having a central hollow H. On the average 85% of the granules have a diameter of less than 4 mm and the bulk density of 95% of these granules is between 0.9 and 1.1 kg/$dm^3$. Such granules have an overall moisture content of, on the average, 2.0%, and with the proper starting product as little as 0.5%. In some circumstances the moisture content will rise to 3% or 4%. Furthermore the glassy portion will lie between 88% and 98% so that the product is eminently usable for concrete.

As a quantity of only between 1.0 $m^3$ and 1.4 $m^3$ of water is used per ton of slag, it can be seen that this method is plainly different from the standard granulating method which uses between 6 and 10 times as much water. Expanding typically uses at most 1 $m^3$ of water for each ton of expanded slag. Furthermore experiments have shown that 10 kg of granulated slag can be produced in accordance with the instant invention at an energy cost of 0.43 kwh as compared to a standard cost of 0.54 kwh for standard slag sand which must be ground. Thus there is an energy saving of approximately 20%.

I claim:

1. A method of granulating slag comprising the steps of:

passing molten slag along an inclined trough;

cooling said molten slag in said trough by mixing said molten slag with a predetermined limited quantity of water insufficient to cool said slag below the threshold of pyroplasticity;

thereafter stiffening the cooled molten slag by mixing same with between 0.5 $m^3$ and 0.7 $m^3$ of water per ton of slag to form a stiffened slag mass;

impinging said stiffened slag mass on a rotating drum and thereby breaking said mass up into fine particles and projecting said particles through the air to a collection location; and collecting said particles at said location.

2. The method defined in claim 1 wherein said slag is mixed with water in the cooling step in the upstream third of said trough, said slag having a residence time of between 5 sec and 8 sec in said trough.

3. The method defined in claim 2 wherein said slag is mixed with water in the stiffening step at a rate of between 0.3 $m^3$ and 0.4 $m^3$ of water per ton of slag.

4. The method defined in claim 2 wherein said drum is rotated at a speed between 600 rpm and 1000 rpm.

5. The method defined in claim 2 wherein said water is process water at a temperature of at least 40° C.

* * * * *